US011464301B2

(12) United States Patent
Pesenti

(10) Patent No.: US 11,464,301 B2
(45) Date of Patent: Oct. 11, 2022

(54) DEVICE FOR ATTACHING A BRACELET

(71) Applicant: Montres Breguet S.A., L'Abbaye (CH)

(72) Inventor: Jean-François Pesenti, Morbier (FR)

(73) Assignee: Montres Brennet S.A., L'Abbaye (CH)

( * ) Notice: Subject to any disclaimer, the term of this patent is extended or adjusted under 35 U.S.C. 154(b) by 209 days.

(21) Appl. No.: 16/885,330

(22) Filed: May 28, 2020

(65) Prior Publication Data

US 2020/0405016 A1 Dec. 31, 2020

(30) Foreign Application Priority Data

Jun. 28, 2019 (EP) ..... 19183418

(51) Int. Cl.
*A44C 5/14* (2006.01)

(52) U.S. Cl.
CPC ..... *A44C 5/147* (2013.01)

(58) Field of Classification Search
CPC ..... A44C 5/147; A44C 5/14; Y10T 24/4718; G04B 37/1486; G04B 37/1493
See application file for complete search history.

(56) References Cited

U.S. PATENT DOCUMENTS

| | | | |
|---|---|---|---|
| 2019/0000195 A1 | 1/2019 | Golay et al. | |
| 2019/0121295 A1 | 4/2019 | Romano et al. | |

FOREIGN PATENT DOCUMENTS

| | | | | |
|---|---|---|---|---|
| CH | 179155 A | * | 12/1933 | |
| CH | 712775 B1 | * | 1/2018 | |
| CH | 713 948 A2 | | 1/2019 | |
| EP | 3 473 126 A1 | | 4/2019 | |
| FR | 2738123 A1 | * | 3/1997 | ..... A44C 5/14 |
| JP | 2019-12069 A | | 1/2019 | |
| JP | 2019-76704 A | | 5/2019 | |

OTHER PUBLICATIONS

Communication dated May 25, 2021 from the Japanese Patent Office in Application No. 2020-101393.
European Search report for EP 19 18 3418 dated Dec. 16, 2019.

* cited by examiner

*Primary Examiner* — Jack W Lavinder
(74) *Attorney, Agent, or Firm* — Sughrue Mion, PLLC

(57) ABSTRACT

A device for attaching a bracelet to a watch case, the device including, on the one hand, a bar secured to the watch case by a horn, and on the other hand, an insert integral with the end of a bracelet, wherein the bar and the insert are complementary in order to cooperate by interlocking to form removable assembly to make the bracelet interchangeable. The bar is formed by a cylindrical hollow body provided with two retractable pivots, and having at least one housing arranged to cooperate by interlocking with an insert, the bar including a device for holding the insert, and being arranged so as to pivot from a first position, in which the insert is capable of being positioned on the bar, into a second position in which the insert is locked onto the bar by locking device cooperating with the holding device.

12 Claims, 3 Drawing Sheets

DEVICE FOR ATTACHING A BRACELET

CROSS-REFERENCE TO RELATED APPLICATION

This application claims priority to European Patent Application No. 19183418.3, filed on Jun. 28, 2019, the entire contents of which are incorporated herein by reference.

FIELD OF THE INVENTION

The present invention relates to the field of horology or jewellery. More specifically, it concerns a device for attaching a bracelet to an object, particularly a watch case.

BACKGROUND OF THE INVENTION

Generally, bracelets, made of leather or metal, are attached to the horns of a watch case by means of a bar formed by a tube, inside which are mounted two pistons that move in translation, and an elastic member disposed between said pistons and intended to drive them outwardly of the tube. Said bar is mounted inside a housing provided for this purpose at one end of the bracelet, and the pistons are engaged in blind bores facing them in the horns of the case.

To detach a bracelet attached to a case in this manner, it is necessary to have a tool designed to push the pistons back inside the tube, against the stress exerted by the elastic member, and thereby remove them from the bores. The wearer of the watch does not permanently carry such a tool, and moreover, the tool can be inconvenient to use. This is why bracelets provided with such an attachment device are generally permanently secured to the case.

There are also attachment devices that allow the bracelet to be removed from the case without using a tool. Such devices usually comprise a bar, of the type described above, on which is mounted, through the tube, a member for actuating the pistons. Said actuation member is, for example, a radial finger integral with one of the pistons, as described in Swiss Patent No. 327838. The finger is mounted such that it slides through an axial slot made in the tube, and its movement along the slot pushes one of the pistons inside the tube.

Swiss Patent No. 614589 discloses a watch case with a device for attaching a bracelet to the case, the central horn has a cylindrical passage that is slit longitudinally over the entire length of the horn, to allow insertion of a bar for attaching a bracelet. The bar takes the form of a cylinder with a flat portion along its entire length to allow the bar to pass when it is inserted into the passage and to hold the bar in place when the latter occupies a determined angular position.

The attachment devices thus described are generally employed for interchangeable bracelets which the user can then change as desired. They are not, however, free of drawbacks. It will be noted in particular, that they require major structural modifications to the bar, such as, for example, making an opening in the tube, or transforming the pistons. These changes entail significant extra manufacturing costs. These attachment devices also include a protruding element, namely the actuating member, which may snag or injure the wearer of the watch.

SUMMARY OF THE INVENTION

The present invention makes it possible to overcome these drawbacks by proposing a device for attaching a bracelet to a watch case, the device comprising, on the one hand, a bar secured to the watch case by means of at least one horn, and on the other hand, an insert integral with the end of the bracelet, wherein the bar and the insert are complementary in order to cooperate by fitting one inside the other to form removable assembly means able to make the bracelet interchangeable.

According to the invention, the bar is formed by a cylindrical hollow body provided with two retractable pivots, and has at least one housing arranged to cooperate by interlocking with said at least one insert, said bar comprising means for holding the insert, the bar being arranged so as to pivot from a first position A, in which the insert is capable of being positioned on the bar, into a second position B in which said insert is locked onto the bar by means of locking means cooperating with said holding means.

According to other advantageous alternative embodiments of the invention:

- each of the pivots comprise a post arranged so as to slide in a longitudinal groove formed in the body of the bar, said pivots being separated by a spring;
- said means for holding the at least one insert are formed, on the one hand, by a point of a pivot, and on the other hand, by a hollow formed in the insert, each point being arranged so as to be housed inside a hollow when the insert is inserted into the housing;
- the point of each pivot at least partially projects into a housing;
- said locking means comprise at least one additional groove extending from one of the ends of the longitudinal groove in a substantially perpendicular direction relative to a longitudinal groove, the at least one additional groove being arranged so as to cooperate with at least one post when the bar pivots from position A to position B;
- the at least one additional groove extends while slightly diverging so as to form an angle slightly greater than 90° with the longitudinal groove, preferably an angle that lies in the range 91° to 95°;
- the at least one additional groove has a length that is less than that of the longitudinal groove;
- the bar comprises at least one collar at at least one of the ends thereof, said collar forming an axial retaining element cooperating with at least one lateral stop surface of the watch case;
- said watch case comprises means for holding the bar in position, said holding means comprising at least one ball catch arranged so as to cooperate with at least one cavity formed on the body of the bar;
- the watch case comprises a median horn comprising a passage whose diameter corresponds to the diameter of the body of the bar;
- said bar comprises a housing in the vicinity of each of the ends thereof, a housing being disposed on either side of the longitudinal groove;
- said median horn comprises a removable cover held on the case by screws.

BRIEF DESCRIPTION OF THE DRAWINGS

Other features and advantages of the present invention will more clearly emerge upon reading the following detailed description of one example embodiment of an attachment device for a bracelet according to the invention, this example being provided for the purposes of illustration only and not intended to limit the scope of the invention, given with reference to the accompanying drawing, wherein.

DETAILED DESCRIPTION OF THE PREFERRED EMBODIMENTS

FIGS. 1 to 6 show a wristwatch and detailed views of the device for attaching the bracelet to the watch case 1 according to a preferred embodiment of the invention. The device for attaching the bracelet 2 to the watch case 1 comprises, on the one hand, a bar 4 secured to the watch case by means of at least one horn integral with the case, and on the other hand, an insert integral with the end of the bracelet 2, wherein the bar 4 and the insert 21 are complementary in order to cooperate by fitting one inside the other to form removable assembly means able to make the bracelet interchangeable.

Figure 3A:
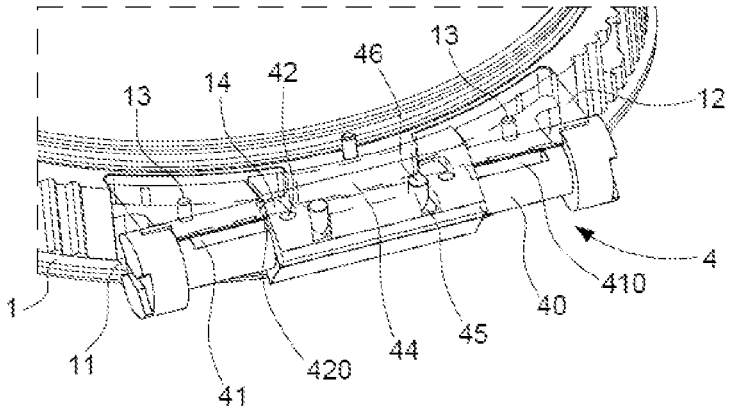
FIGS. 3*a* to 3*c* show transparent, perspective views of the bar of an attachment device according to the invention equipping a watch case.
Figure 3B:
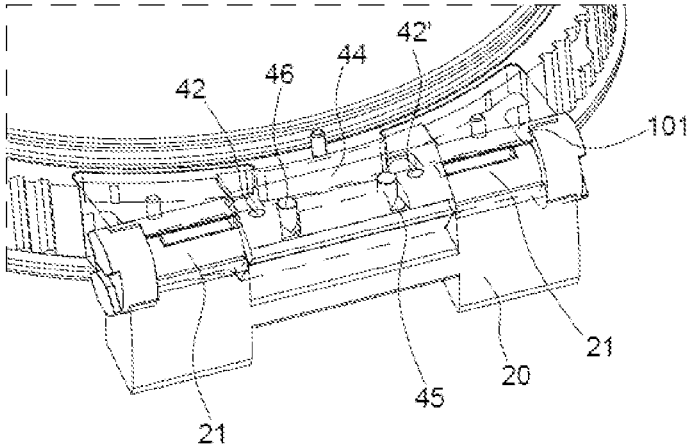

As shown in FIGS. 3*a* to 3*b*, the watch case comprises a median horn comprising a passage, whose diameter corresponds to the diameter of the shaft of the bar 4 such that the latter can turn freely inside the housing. The median horn 10 consists of two parts, a first part 11 formed with the watch case and comprising a groove 110 arranged so as to receive the bar 4, and a second part formed by a removable cover 12 held on the first part, and implicitly on the watch case 1, by means of screws 13. Such an arrangement makes it possible to assemble and disassemble the bar 4 quickly and easily without the risk of damaging or of twisting same.

Advantageously, the watch case 1 comprises means for holding the bar 4 in position. As shown in the figures, these holding means take on the form of a pair of ball catches 14, each ball catch 14 being arranged so as to cooperate with a first pair of cavities 42 and a second pair of cavities 42' formed on the body 40 of the bar 4.

Figure 4:
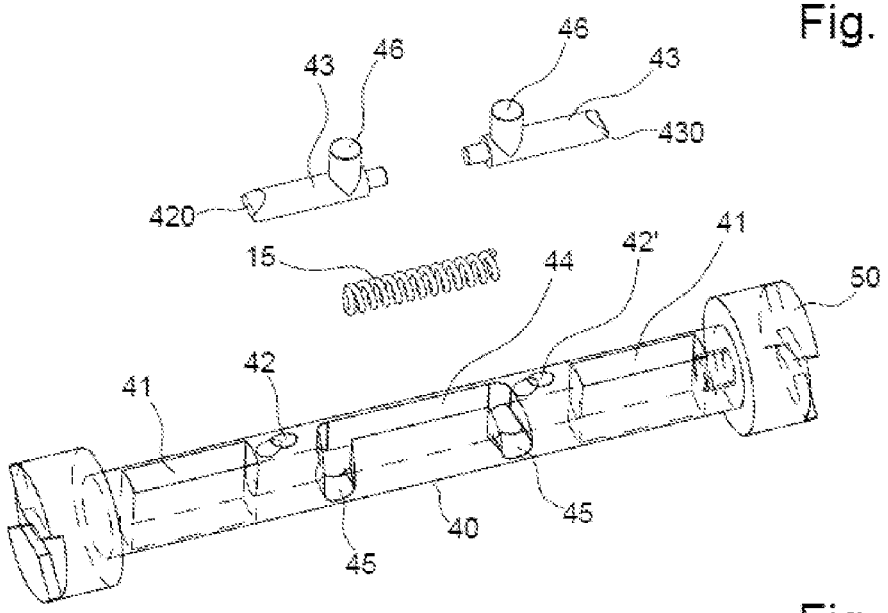
FIG. 4 shows the bar and the locking means of an attachment device according to the invention.

According to the invention, the bar 4 is formed by a hollow cylindrical body 40 having at least one housing 41, the housing 41 being arranged so as to cooperate by interlocking with at least one insert 21 made in a connecting link 20 of the bracelet strand 2 or of a link. The bar 4 further comprises first and a second pivot 43 arranged in the hollow body 40, the two pivots being separated by a spring 15 held such that it bears against the ends of the two pivots. As shown in FIG. 4, the spring 15 is, for example, a helical spring.

Each first and second pivot 43 is capable of sliding inside the hollow body 40. The hollow body 40 is provided with a longitudinal groove 44 at the centre of the bar, the longitudinal direction being taken to be the longest direction in which the hollow body 40 extends. The longitudinal groove 44 forms an opening in the surface of the hollow body 40. The hollow body 40 further includes two additional grooves 45 extending from the ends of the longitudinal groove 44. In the embodiment shown in FIGS. 3*a* to 3*c*, the additional grooves 45 extend perpendicularly relative to the longitudinal groove 44, or according to an angle that is close to 90°. The additional grooves 45 also form an opening in the surface of the hollow body 40. Each of the additional grooves 45 has a length that is less than that of the longitudinal groove 44.

Each of the pivots 43 further comprises a post 46 integral therewith. The post 46 extends from an outer surface of the pivot, substantially perpendicularly to the longitudinal direction in which the pivots extend. Each post 46, integral with a pivot 43, extends through the longitudinal groove 44 of the hollow body of the bar 4, and is capable of sliding along this groove 44. Moreover, as shown in FIG. 4, the pivot and the post are preferably formed integrally in one piece with one another.

Advantageously, the removable cover 12 has, on the inner face thereof, at least one oblong machining 16 arranged so as to cooperate with a post 46, the length of the machining defining the length of travel of the pivot.

As shown in the figures, the bar 4 comprises two housings 41, disposed on either side of the longitudinal groove 44, and having a substantially rectangular opening 410 for receiving an insert 21 of the bracelet strand 2, the height and the length of the opening 410 corresponding to the height and to the length of the inserts 21 of the bracelet strand.

Each of the housings 41 is penetrating such that the point 420, 430 of the pivots 43 can open out into these housings 41, the ends of the longitudinal groove 44 forming bankings for the posts 20 of the pivots 43. Advantageously, the distance between the point 420, 430 of each pivot and each post 46 is provided such that it is slightly greater than the distance separating the housing 21 from the groove 44.

According to the preferred embodiment of the invention shown in the figures, the bracelet strand 2 comprises two inserts 41 such that there is one insert 21 on either side of the median horn 10, each of the inserts 21 cooperating by interlocking with a housing 41.

Figure 5:
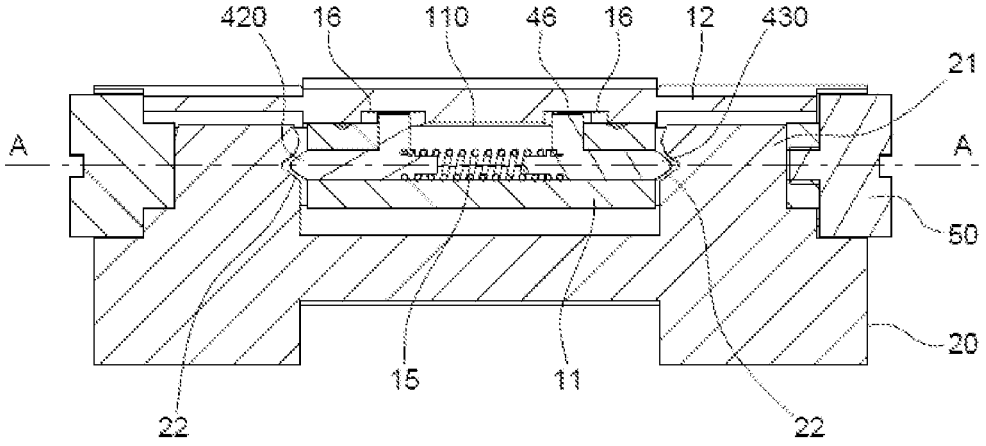
FIG. 5 shows a sectional view of the attachment device according to the invention.
Figure 6:
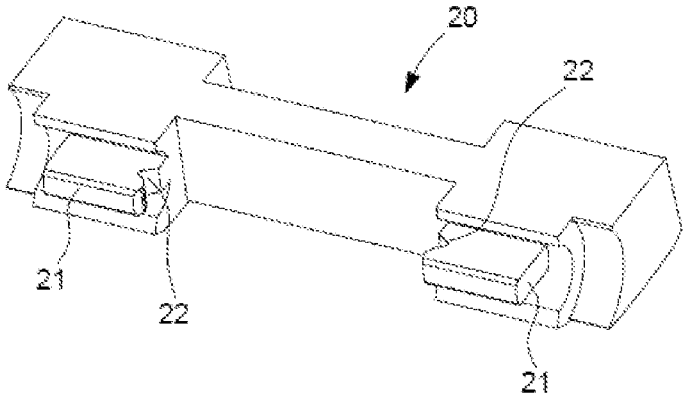
FIG. 6 shows a perspective view of a connecting link arranged so as to cooperate with the attachment device according to the invention.

As shown in FIGS. 5 and 6, each insert 21 has, on the face opposite a pivot, a hollow 22 arranged so as to cooperate with the point of a pivot 43. This arrangement allows the bracelet strand or the connecting link 20 to be clipped onto the watch case 1 when the inserts 21 are placed inside the housings 41.

Advantageously, the bar 4 is arranged so as to pivot from a first position A, in which the one or more openings 41 of the bar 4 are capable of receiving the one or more inserts 21, into a second position B in which said inserts are locked onto the bar 4.

According to the invention, the bar 4 is pivoted from position A into position B by means of the bracelet strand 2 once the inserts 21 are in place inside the housings 41, the posts 46 thus being positioned inside the grooves 45. Preferably, the grooves 45 extend while slightly diverging so as to form an angle slightly greater than 90° with the longitudinal groove 44, for example an angle that lies in the range 91° to 95°. Such an arrangement allows the pivots 43 (and thus the bracelet strand) to be firmly held in the locked position and the play present between the pivots and the inserts of the bracelet strand to be eliminated.

As shown in the figures, the bar 4 comprises a collar 50 integral with each of the ends of the bar 4, the bar and the collars 50 thus forming a single element. The collar 50 could also be assembled at the end of the bar 4 by way of an insertion point mounted in a hollow part of the bar 4. An inner bulge is thus made at the end of the bar 4 in order to cooperate with the insertion point, so as to clip the collar 50 inside the bar 4. Other modes for attaching the collars 50 can be considered, such as bonding, welding or even press fitting, for example. The latter act as axial retaining elements for the bar 4 and the insert 21.

Thus, the bar 4 can be comprised of three parts, or can form only one, with the collars 50 being pre-cast at the ends of the arbor 40, the housings 41, the cavities 42, 42', and the grooves 44 and 45 then being milled directly in the body 40. Moreover, the section of the bar 4 and collars 50 were chosen such that they are preferably cylindrical so as to favour a degree of rotational freedom about the A-A axis thereof.

Advantageously, the median horn 10 acts as a radial retaining element, complementary to the groove 110, the shape and the depth whereof are complementary to those of the body 40 such that the bar 4 cannot exit the groove 110 when being positioned. In FIGS. 3*a* to 3*b*, the median horn 10 can be seen to comprise two housings receiving the ball catches 14, the latter being arranged so as to cooperate with the cavities 42, 42' of the bar 4, the respective sizes and depths thereof are configured such that the bar 4 no longer has any degree of freedom within the groove 110 when the catches 14 are engaged in the cavities 42 or 42' of the bar 4.

Figure 1:
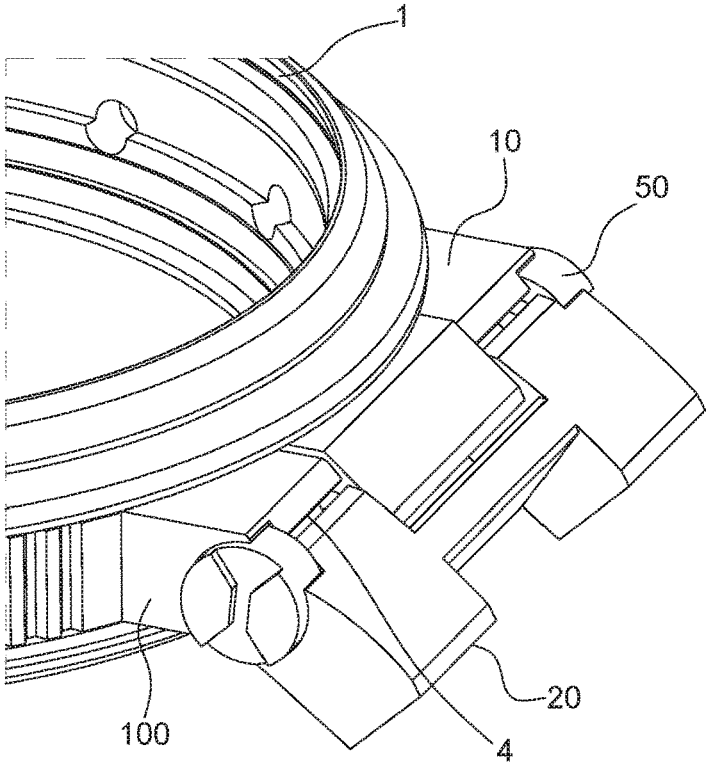
FIGS. 1 and 2 respectively show perspective views of a watch case equipped with an attachment device according to the invention in the locked position and in the unlocked position.
Figure 2:
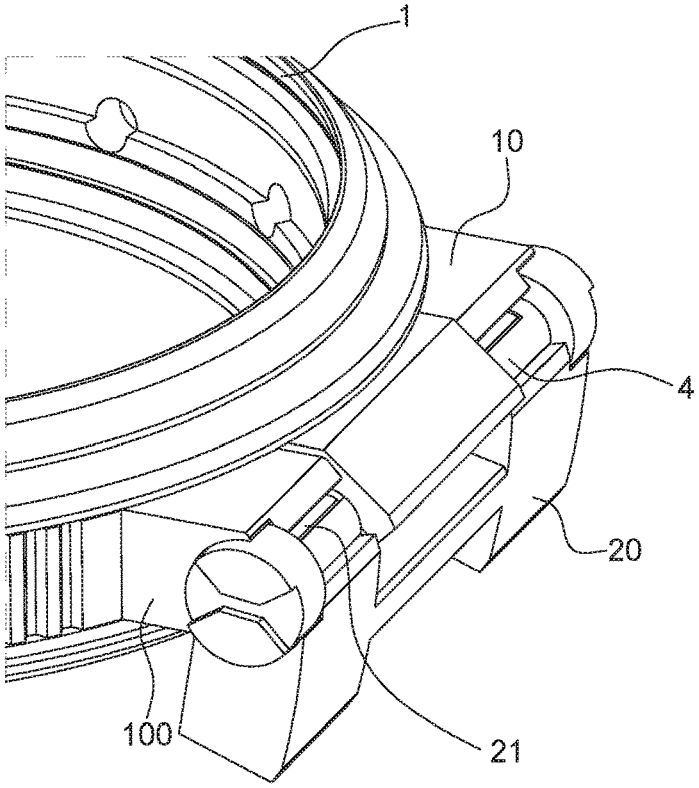

According to the preferred embodiment shown in FIG. 1, the watch case 1 comprises first lateral vertical walls 100 opposite which lateral clearings 101 are provided in the middle part of the case for housing the collars 50 of the bar 4. In this case, the collars 50 take a cylindrical shape, the lateral clearings 101 have a corresponding cylindrical shape excavated in the watch case 1.

In order to attach the bracelet 2 to the case 1 as shown in FIGS. 3*a* to 3*b*, the inserts 21, for example corresponding to the end of a strand or of a connecting link 20, are inserted into the bar 4 by presenting the inserts in front of the openings 410 of the housings 41 in the bar 4. In the first position A thereof, the bar 4 allows access to the housings 41 and the placement of the inserts 21 from the bottom, the openings 410 being oriented downwards relative to the watch case 1. A "click" allows the bracelet to be positioned when the inserts 21 are engaged by the pivots 43, preventing the bracelet from falling, and easing rotational locking without exerting pressure thereon.

Figure 3C:
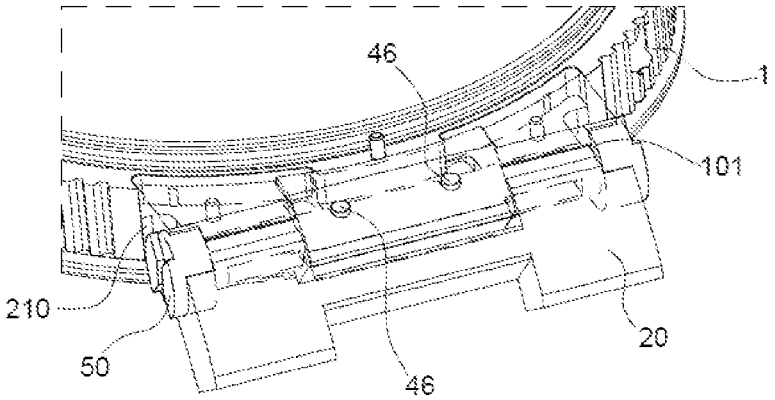

Once the one or more inserts 21 are in place on the bar 4, the user pivots the bar about the A-A axis by way of the bracelet strand into position B until the bar undergoes a rotation of at least 45° about the A-A axis relative to position A thereof, and more preferably 90°, thus preventing the bracelet strand from being dislodged as shown in FIG. 3*c*.

In position B, the ball catches 14 cooperate with the first cavities 42 of the body 40 of the bar 4 so as to lock the bar in position B.

In order to disassemble the bracelet, the operations must simply be carried out in reverse order while exerting a low force on the bracelet to disengage the inserts 21 from the pivots 43.

The insert 20 matches the shape of the median horn 10 to limit play during assembly and to provide a high-quality assembly.

In the embodiment described above, the insert is disposed on a connecting link, itself connected to a bracelet made of leather, synthetic fabric, plastic, metal, ceramic or even composite material. Likewise, the bar 4 is preferably made of metal but could also be made of plastic, ceramic or even composite material.

As a result of these different aspects of the invention, a secure bracelet attachment device is obtained, allowing the bracelet to be quickly and easily changed.

It goes without saying that the present invention is not limited to the example shown and that various alternatives and amendments that may be apparent to a person skilled in the art can be made thereto.

The invention claimed is:

1. A device for attaching a bracelet (2) to a watch case (1), the device comprising a bar (4) secured to the watch case (1) by means of at least one horn (10), and an insert (21) integral with the end of a bracelet, wherein the bar (4) and the insert (21) are complementary in order to cooperate by fitting one inside the other to form removable assembly means able to make the bracelet interchangeable, wherein the bar (4) is formed by a cylindrical hollow body (40) provided with two retractable pivots (43), and having at least one housing (41), said housing being arranged to cooperate by interlocking with said at least one insert (21), said bar comprising means for holding the at least one insert, the bar (4) being arranged so as to pivot from a first position A, in which the insert (21) is capable of being positioned on the bar (4), into a second position B in which said insert is locked onto the bar (4) by means of locking means cooperating with said holding means.

2. The attachment device according to claim 1, wherein each of the pivots (43) comprise a post (46) arranged so as to slide in a longitudinal groove (44) formed in the body (40) of the bar, said pivots being separated by a spring (10).

3. The attachment device according to claim 1, wherein said means for holding the at least one insert are formed by a point (420, 430) of a pivot (43), and by a hollow formed in the insert (21), each point being arranged so as to be housed inside a hollow when the insert is inserted into the housing.

4. The attachment device according to claim 3, wherein the point (420, 430) of each pivot (43) at least partially projects into a housing (21).

5. The attachment device according to claim 2, wherein said locking means comprise at least one additional groove (45) extending from one of the ends of the longitudinal groove (44) in a substantially perpendicular direction relative to the longitudinal groove (44), the at least one additional groove (45) being arranged so as to cooperate with at least one post (46) when the bar (4) pivots from position A to position B.

6. The attachment device according to claim 5, wherein the at least one additional groove (45) extends while slightly diverging so as to form an angle slightly greater than 90° with the longitudinal groove (44), preferably an angle that lies in the range 91° to 95°.

7. The attachment device according to claim 5, wherein the at least one additional groove (45) has a length that is less than that of the longitudinal groove (44).

8. The attachment device according to claim 1, wherein the bar (4) comprises at least one collar (50) at at least one of the ends thereof, said at least one collar (50) forming an axial retaining element cooperating with at least one lateral stop surface of the watch case (1).

9. The attachment device according to claim 1, wherein said watch case (1) comprises means for holding the bar in position, said holding means comprising at least one ball catch (14) arranged so as to cooperate with at least one cavity (42, 42') formed on the body (40) of the bar.

10. The attachment device according to claim 1, wherein the watch case comprises a median horn comprising a passage whose diameter corresponds to the diameter of the body of the bar.

11. The attachment device according to claim 10, wherein said bar (4) comprises a housing (41) in the vicinity of each of the ends thereof, a housing (41) being disposed on either side of the longitudinal groove (44).

12. The attachment device according to claim 10, wherein said median horn (10) comprises a removable cover (11) held on the case (1) by screws.

* * * * *